United States Patent [19]

Issakainen et al.

[11] Patent Number: 4,576,525

[45] Date of Patent: Mar. 18, 1986

[54] METHOD AND EQUIPMENT FOR PERFORMING ROCK BOLTING

[75] Inventors: Onni Issakainen; Pertti Heikkilä, both of Tampere, Finland

[73] Assignee: Oy Tampella AB, Tampere, Finland

[21] Appl. No.: 583,023

[22] Filed: Feb. 23, 1984

[30] Foreign Application Priority Data

Apr. 26, 1983 [FI] Finland ..... 831423

[51] Int. Cl.[4] ..... E21C 11/00

[52] U.S. Cl. ..... 405/269; 405/261

[58] Field of Search ..... 405/259, 260, 303, 269, 405/261; 29/813; 414/22

[56] References Cited

U.S. PATENT DOCUMENTS

| | | | |
|---|---|---|---|
| 4,215,953 | 8/1980 | Perraud | 405/259 |
| 4,226,559 | 10/1980 | Prebensen | 405/303 |
| 4,229,124 | 10/1980 | Frey et al. | 405/303 |
| 4,398,850 | 8/1983 | Talvensaari | 405/261 |
| 4,420,277 | 12/1983 | Hibbard et al. | 405/260 |

*Primary Examiner*—Dennis L. Taylor

*Attorney, Agent, or Firm*—Ladas & Parry

[57] ABSTRACT

A method for performing rock bolting, according to which a cementing agent is fed into a hole drilled into the rock, whereupon a bolt is fitted into the drill hole for supporting the rock. In order to permit use of a rapidly hardening cementing agent and mechanization of the bolting, a number of capsules (16) are fed to the bottom of the drill hole, which capsules contain a preferably two-component cementing agent which hardens rapidly when the components are mixed together, and a conventional cementing agent (12) hardening slowly and/or protecting the bolt against corrosion is fed into the remaining portion of the drill hole by means of a feeding pipe (5). The equipment for carrying out the method comprises a guide (14) for shifting a capsule/-capsules (16) form a charging station (15) into the drill hole, means (22) for moving the guide axially back and forth, means (17) for shifting the capsule/capsules (16) along the guide (14), and a nozzle (9) to be positioned at the mouth of the drill hole, through which nozzle both the guide (14) and the feeding pipe (5) can be shifted alternatingly into the drill hole.

3 Claims, 7 Drawing Figures

Figure 1:
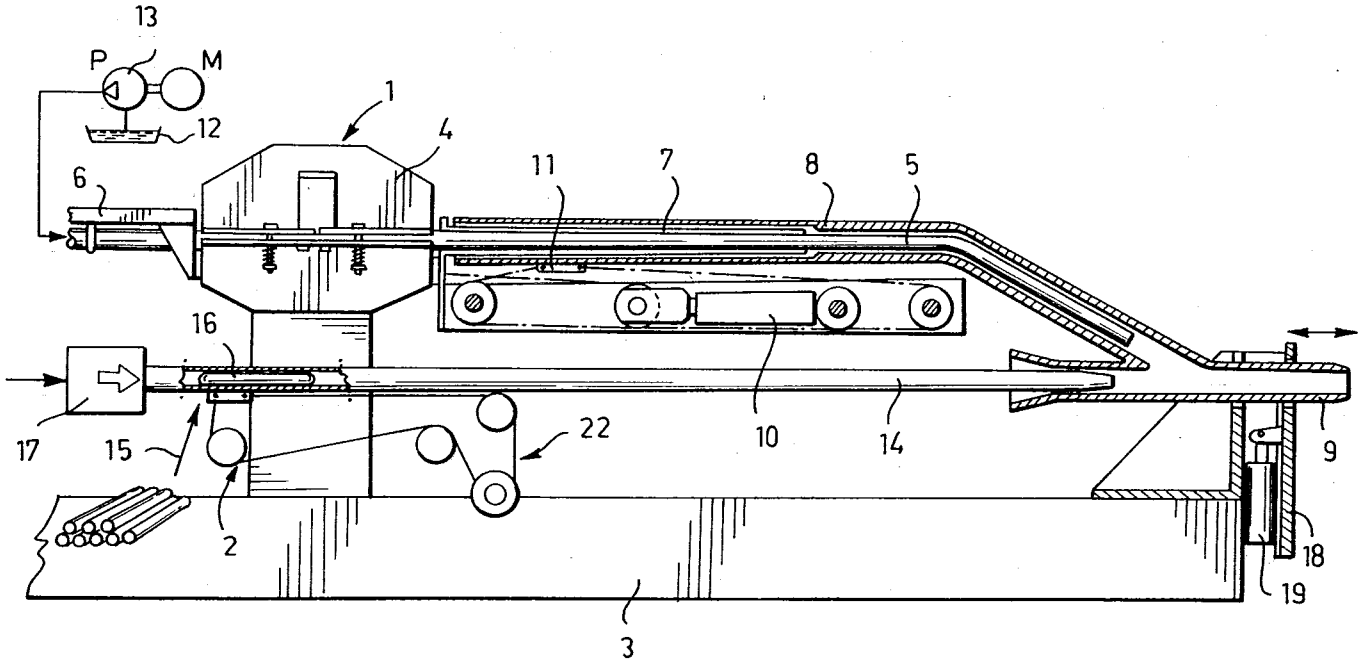

20
9
5
14
4

9
5
14

16
16
14

16
16
5
14

16
16
12
5
14

21

METHOD AND EQUIPMENT FOR PERFORMING ROCK BOLTING

The present invention concerns a method for performing rock bolting, according to which method a cementing agent is fed into a drill hole drilled into the rock, whereupon a bolt or equivalent is fitted into the drill hole for supoorting the rock.

It is earlier known to perform rock bolting by feeding concrete into the drill hole and by thereupon installing a bolt into said hole. Since the hardening of concrete is relatively slow, the bolt must be secured in the hole by some mechanical means until the concrete has hardened sufficiently to keep the bolt in the hole. Nor is it possible, by means of this method, to prestress the bolt in order to perform a preliminary supporting, because the prior-art mechanical solutions for fastening the bolt can hardly receive a load greater than the weight of the bolt.

From the Swedish patent publication No. 395,504, it is known first to feed more rapidly hardening concrete into the drill hole, and thereupon ordinary concrete, whereafter the bolt is installed in its position. In this solution, the concrete which hardens more rapidly fixes the bolt end rapidly in the rock, whereby the upper end of the bolt adheres in the drill hole relatively rapidly and it is possible to tighten a washer and a nut at the lower end of the bolt for provisional supporting of the rock until the rest of the concrete hardens.

It is a drawback of this solution that the rapidly hardening concrete can be prepared for one or two drill holes only at a time. When larger quantities are prepared, the rapidly hardening concrete hardens excessively before it can be used. Because of this that the method cannot be mechanized. Equipment used for feeding the rapidly hardening concrete becomes unusable in a short time, because the hardening concrete blocks the pipe system and the feeding pump. Moreover, such a concrete, however, hardens too slowly to permit preliminary tensioning of the bolt immediately upon installation of the bolt.

From said Swedish publication, it is also known to fit a bolt by fist feeding a capsule to the bottom of the drill hole, which capsule contains an accelerator for concrete and balls, and by thereupon feeding normal concrete into the hole. In connection with this method, special bolts are used having a sharp tip. When the bolt is inserted into the hole and rotated, the bolt breaks the accelerator into a rapidly hardening concrete mixture. At the same time, when the bolt penetrates between the balls, its upper end is secured by pressing, whereby the bolt remains in the hole until the more rapidly hardening mixture has solidified, whereupon the bolt can be pretightened. It is a drawback of this method that special accelerator-ball capsules are required, which cannot be used in any other way, as well as a special sharp-pointed bolt, which causes unnecessarily high manufacturing costs. Another drawback of the method is that, if a higher pretightening force is required, the number of accelerator capsules cannot be increased in order to increase the quantity of the rapidly hardening mixture, because this would result in a very rapidly hardening concrete mixture which would be relatively brittle and which would stand less load than a concrete mixture hardened by means of a lower quantity of accelerator.

From said Swedish publication, it is further known to perform concrete-cement bolting by feeding to the bottom of the drill hole one two-part capsule only, in which one part contains a cementing agent and the other part an accelerating agent, whereby, when the bolt is pushed into the hole and rotated, the agents are mixed together and form a rapidly hardening mixture and fasten the tip of the bolt rapidly to the bottom of the hole, whereupon the bolt can be tightened in order to support the rock. It is a drawback of this method that the rest of the bolt remains unprotected and, in the course of time, its strength is deteriorated by the effect of corrosion. Nor become the various cracks in the rock and the main part of the bolt cemented, so that the entire load rests on the tip portion of the bolt alone, which increases the possibility of damage owing to effects of corrosion.

From the German published patent application No. 26 56 180 it is known to feed two-component capsules into the drill hole in order to cement the entire bolt by means of the capsules, whereby the bolt, when pushed into the hole, crushes the capsules and mixes a rapidly hardening cementing agent (usually resin) over the entire length of the bolt, whereby the bolt can be cemented rapidly over its entire length and the tightening of the bolt can be performed almost immediately upon its insertion. It is a drawback of this method that such two-component capsules are quite expensive and consequently the cost of cement bolting is remarkably high as compared with cement bolting by means of concrete. Nor can the method be used for the installation of long bolts, because the cementing agent of the capsules first crushed will harden before the entire bolt has been inserted into the hole.

It is an object of the present invention to provide a method for cement bolting, in which method the tip portion of the bolt can be fixed in the drill hole rapidly over the necessary length so that the bolt can be tightened preliminarily for obtaining a provisional support, while yet keeping the cost of the cement bolting as low as possible.

It is a further object of the invention to provide a method which can be mechanized in order to facilitate the bolting and to reduce the costs further.

A further object of the invention is to provide a method by means of which it is possible to make use of the advantages of a rapidly hardening cementing agent even when long bolts are being installed.

According to the invention, this is accomplished by using for fixing of the tip portion of the bolt capsules containing a rapidly hardening two-component agent, one or several such capsules being fed to the bottom of the drill hole, and by filling the required part of the remaining drill hole with ordinary slowly hardening concrete or with any other suitable cementing and/or corrosion-inhibiting agent, whereby, when the bolt is inserted into the hole, the two-component capsules are mixed to a rapidly hardening cementing agent and fasten the bolt tip, and the concrete or equivalent is hardened in the course of time less rapidly, fastening the rest of the bolt and protecting the bolt against the effects of corrosion.

More specifically, the invention is characterized in that a number, chosen on the basis of the requirement, of capsules are fed to the bottom of the drill hole, which capsules contain preferably two-component cementing agent which hardens rapidly when the components are mixed together, and that a conventional cementing agent hardening slowly and/or protecting the bolt against corrosion is fed into the possible remaining portion of the drill hole by means of a feeding pipe in itself known.

By means of this method it is possible, by selecting the number of the two-component capsules on the basis of the risk of collapsing and the brokenness of the rock, to provide a sufficient load resistance for the bolt, whereby, in a solid rock, it is possible to use one two-component capsule only, and in a broken rock and possibly in a situation with a risk of collapsing, when shorter bolts are used, it is possible to use resin even over the entire length of the bolt. In this way, it is possible to use a minimum quantity of expensive two-component cementing agent without deterioration of safety and strength of the cementing as a whole, and to secure the cementing, e.g., by means of inexpensive concrete. In connection with the method, it is also possible to use ordinary inexpensive blunt-ended bolts or various simple concrete steel rods provided with support discs, whose cost of manufacture is even lower than that of bolts.

This method can also be mechanized in a simple way, because no premature hardening of the rapid cementing agent takes place in the equipment and the rapid cementing agent is not formed until in the drill hole, where its hardening is desirable.

In addition to the method, the present invention also concerns an equipment for carrying out the method, and the equipment is characterized by the features according to claim 6. By means of the equipment, the advantages mentioned in connection with the method are achieved by using a simple construction.

The invention will be described in more detail with reference to the exemplifying embodiment illustrated in the attached drawings, whereby FIG. 1 is a side view of an equipment in accordance with the invention partly as an axial section, and FIGS. 2A to 2F are schematical illustrations of different stages of operation of the equipment shown in FIG. 1.

The equipment shown in FIG. 1 of the drawings includes a feeding device 1 for concrete used as a cementing agent and a feeding device 2 for two-component capsules.

The feeding device 1 for concrete comprises a shifting device 4 for a feeding pipe 5. The shifting device is supported by a frame 3 of the bolting equipment. The feeding pipe 5 can move axially as supported on a guide beam 6. A tubular guide 7 forms an extension of the feeding device and a guide pipe 8 is mounted axially slidingly on said guide 7 and terminates diagonally at the side of a nozzle 9. For axial displacing of the guide pipe, an actuating device 10 is provided, which operates by means of a wire etc., which is displaceable by means of a hydraulic cylinder and which runs over pulleys and is attached to the guide pipe 8 at 11.

Concrete 12 is fed into the feeding pipe by means of a pump 13.

The feeding device 2 for two-component capsules comprises a feeder pipe 14 forming a guide, whose end extends into the lower end of the nozzle 9 and is displaceable axially through the nozzle. Moreover, the device is provided with a displacing mechanism 22 for shifting the feeder pipe 14 axially through the nozzle 9, whereby the pipe is preferably coaxial with the nozzle. The displacing mechanism may be, e.g., similar to the actuating device 10, or any other suitable mechanism. At the other end the pipe 14 is attached to a charging station 15 for the inserting of two-component capsules 16, e.g., one by one, into the feeder pipe 14. The feeder pipe is connected with a mechanical, pneumatic or some other shifting device 17 for feeding the capsule through the feeder pipe into a drill hole 20. In the embodiment of FIG. 1, a water connection is denoted in the shifting device 17 by means of an arrow. This water connection is not always necessary, but the suggested water connection can be utilized in many ways. For example, the capsule/capsules 16 may be fed into the drill hole by means of water, in which case the water pushes the capsule forwards in the feeder pipe until the capsule is in the drill hole. If necessary, the capsule 16 can in this way be pushed deep into the drill hole if a long feeder pipe is used. The water connection may also be utilized for washing the drill hole. In such a case, water is sprayed into the drill hole through the feeder pipe, which water washes any stone crumbs out of the hole before the capsule is fed into the drill hole.

In addition to the above functions, the water connection may also be used for washing the bolting equipment. In such a case, water is sprayed through the feeder pipe against the rock located above the bolting equipment, whereby the water falls down upon the bolting equipment and washes off the stone dust. In such a case the maintenance and cleaning of the equipment can be simplified, while at the same time otaining an improved reliability in operation.

The feeder pipe 14 may be either rigid or flexible. On the contrary, the feeding pipe 5 used for feeding the concrete must be made of a relatively elastic material so that it can be inserted in the drill hole without being jammed.

The nozzle 9 fitted onto the guide pipe 8 is supported on a shifting plate 18, which is displaceable by means of a hydraulic cylinder 19 relative the frame 3 in the transverse direction of the guide pipe 8. The shifting plate 18 and the hydraulic cylinder 19 are, of course, not necessary for operation of the equipment, but since the drill hole is not always necessarily produced at the point at which the drill rod first reaches contact with the rock, owing to unevenness of the rock face and to other reasons, the shifting place is advantageous because it is now possible to compensate minor divergencies and thereby to guarantee proper feed of cement into the hole.

Figures 2A, 2B, 2C, 2D, 2E, 2F:
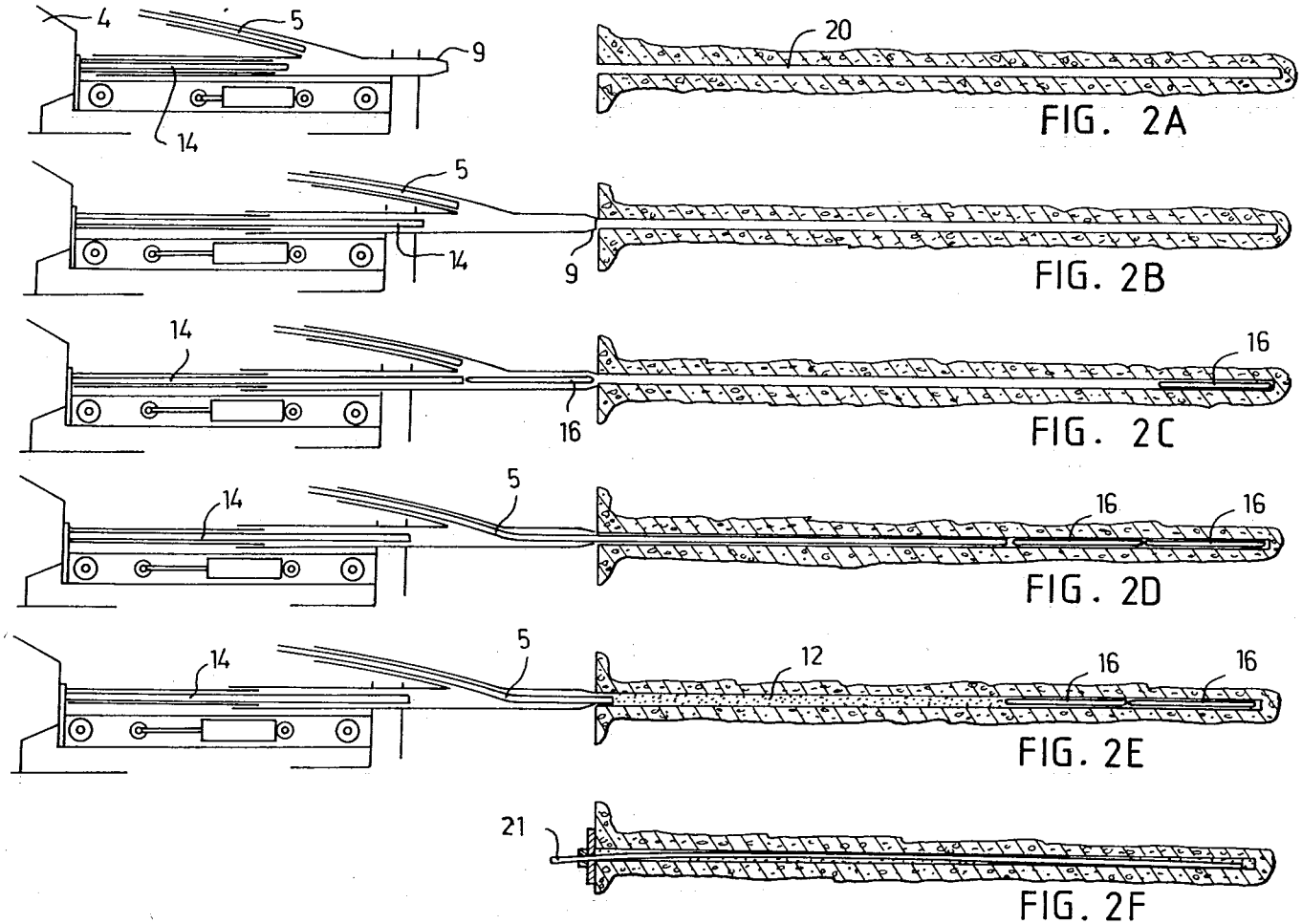

The equipment operates as follows:

After a hole 20 has been drilled into the rock for a rock bolt, the feeding device 1 for a cement agent is shifted on the frame of the bolting equipment into alignment with the hole so that the nozzle 9 is substantially coaxial with the drill hole (FIG. 2A). The guide pipe 8 is shifted by means of the actuating device 10 towards the rock so that the nozzle 9 becomes positioned at the mouth of the drill hole (FIG. 2B). The feeder pipe 14 is shifted by means of the shifting mechanism 22 through the nozzle 9 preferably right in front of the drill hole 20, whereupon one or several two-component capsules 16 are fed through the feeder pipe 14 into the drill hole (FIG. 2C). By shifting the feeder pipe 14 beyond the opening 5 of the concrete feeding pipe, collision of the capsules against the edge of the opening with resulting crushing is prevented. If the pipe 14 has been displaced over the entire length of the nozzle, the capsules 16 can be guided reliably to the centre of the drill hole 20, whereby they have ready access into the hole and are not caught at the mouth of the hole. After the capsule 16 has been fed into the hole, the concrete feeding pipe 5 is shifted by means of the shifting device 4 towards the nozzle 9 and further into the drill hole 20. If the capsule/capsules 16 have during feeding stopped in the hole before its bottom, the tip of the feeding pipe 5 pushes the capsule or capsules ahead of it to the bottom of the hole (FIG. 2D).

Concrete 22 is fed into the drill hole through the pipe 5 at the same time as the pipe is being pulled outwards in the hole (FIG. 2E). After the hole has been filled with concrete, the guide pipe 8 is pulled by means of the actuating device 11 off the mouth of the hole, whereupon the entire feeding device 1 is shifted aside on the frame so that a rock bolt 21 can be pushed into the drill hole (FIG. 2F). The bolt crushes the capsule or capsules 16 so that the initial fixing of the bolt starts immediately and the bolt remains in the hole during the hardening of the concrete. By rotating the bolt, it is possible to ensure a mixing of the two-component agent and, thereby, proper fixing of the bolt.

Thus, in the method in accordance with the invention, both a capsule 16 containing a rapidly hardening two-component agent and ordinary inexpensive concrete 12 can be fed at the desired ratio mechanically into drill holes 20. The number of capsules 16 is chosen on the basis of the magnitude of the initial load that the bolt 21 has to stand and on the basis of the distance over which a rapid cementing is desirable to be performed. For filling the remaining portion of the hole in the desired way, it is possible to use slowly hardening inexpensive concrete or any other suitable material, whose feeding by means of conventional concrete feeding equipment earlier known in the art is easy and simple to combine with the present invention. The entire bolting can be accomplished remote-controlled by means of the method of the invention, which improves the working safety and simplifies the working.

The drawings and the related description are only supposed to illistrate the idea of the invention. In its details, the method and equipment in accordance with the invention may vary within the scope of claims. Thus, for example, as the power source of the shifting place 18, it is not necessary to use a hydraulic cylinder, but solutions of other types are also possible, etc.

What is claimed is:

1. Equipment for performing cement bolting for reinforcement of rock, which equipment comprises a feeding pipe (5) for feeding a cementing agent (12) into a drill hole (20), and means (4 to 10) for shifting the feeding pipe (5) into the drill hole (20), characterized in that the equipment comprises a guide (14) for shifting a capsule/capsules (16) from a charging station (15) into the drill hole (20), means (22) for moving the guide axially back and forth, means (17) for shifting the capsule/capsules (16) along the guide (14), and a nozzle (9) to be positioned at the mouth of the drill hole (20), through which nozzle both the guide (14) and the feeding pipe can be shifted alternatingly into the drill hole (20).

2. Equipment as claimed in claim 1, characterized in that the nozzle (9) is supported on a shifting plate (18) displaceable in a direction substantially transverse to the path of movement of the feeding pipe (5) for the purpose of directing the nozzle (9) to the drill hole (20).

3. Equipment as claimed in claim 1, characterized in that the guide (14) is a feeding pipe.

* * * * *